US005284295A

United States Patent [19]

Steinfeldt

[11] Patent Number: 5,284,295

[45] Date of Patent: Feb. 8, 1994

[54] MAILBOX DELIVERY SIGNAL DEVICE

[76] Inventor: Edward F. Steinfeldt, 4031 Kinney Gulf Rd., Cortland, N.Y. 13045

[21] Appl. No.: 83,707

[22] Filed: Jun. 25, 1993

Related U.S. Application Data

[63] Continuation-in-part of Ser. No. 967,143, Dec. 7, 1992, abandoned.

[51] Int. Cl.[5] ..... B65D 91/00

[52] U.S. Cl. ..... 232/35

[58] Field of Search ..... 232/34, 35, 36, 37, 232/17

[56] References Cited

U.S. PATENT DOCUMENTS 1,839,834 1/1932 Coleman ..... 232/35

3,547,070 12/1970 Schuh ..... 232/35

*Primary Examiner*—Flemming Saether

*Attorney, Agent, or Firm*—Katherine McGuire

[57] ABSTRACT

A mailbox delivery signal device comprises a signal ball of aerodynamic configuration tethered to a support bracket mounted to the door of the mailbox. The support bracket includes a planar support member which extends perpendicular to the mailbox door and includes a circular hole formed therethrough having a diameter smaller than the diameter of the signal ball. The signal ball is tethered to the support bracket and is seated thereon in the circular hole to set the device. Upon opening the door, the ball falls from the bracket and is suspended by the tether below the mailbox housing for clear viewing by a person located remotely therefrom.

5 Claims, 3 Drawing Sheets

MAILBOX DELIVERY SIGNAL DEVICE

REFERENCE TO RELATED APPLICATION

This application is a continuation in part of my prior application Ser. No. 07/967,143, filed on Dec. 7, 1992, now abandoned.

BACKGROUND OF THE INVENTION

This invention relates to devices which signal the delivery of mail to a mailbox and, more particularly, to such a device which may be permanently mounted to a mailbox door and which includes a tethered ball which becomes suspended below the mailbox for easy viewing from a distant location upon opening of the door by a mailman depositing mail in the box, for example.

Various mailbox signaling devices are known in the prior art with examples of such as follows:

U.S. Pat. No. 4,821,953 issued to Poloha on Apr. 18, 1989 discloses a mailbox signal device which comprises a support arm 14 mounted to the mailbox door such that it extends upwardly at an approximately 45° angle thereto when the mailbox door is in the closed position. A planar signal member 20 is fixedly attached at a first end thereof to the support member by a flexible chain. The support member further includes a ring 25 at the opposite end thereof which may be removably passed over the free end of the support arm when the door is closed. When the door is opened, the support member falls from the support arm due to gravity and remains suspended by the chain until re-attached to the support arm. Thus, the owner would re-set the device by re-attaching the second end of the support member to the support arm following each mail pick-up. The opening of the mailbox door releases the support member which the owner may view from a distant location, for example following deposit of mail in the box by the mailman (this assumes, of course, the mailman does not re-attach the second end of the support member to the support arm).

U.S. Pat. No. 4,138,056 issued to Sherrill on Feb. 6, 1979 discloses a mailbox signal device comprising a signal ball mounted to a first end of an elongated, resilient member which is attached at the second end thereof to the side of the mailbox. The resilient member is biased in a vertical position relative to the mailbox with the first end thereof being angled for insertion between the mailbox housing and the mailbox door upon closing the mailbox door which thereby "sets" the device. Upon opening the door, the resilient member carrying the signal ball springs back to a vertical, upright position whereby the owner can view the signal ball from a distant location indicating mail has been deposited in the box.

U.S. Pat. No. 3,426,966 issued to Lay on Feb. 11, 1969 discloses a mailbox signal device comprising an elongated, curved support member fixedly mounted to the mailbox door, and a cylindrical signal member which is tethered to the mailbox housing. To "set" the device, the door is closed and the cylindrical signal member is positioned on the complementary shaped support member. When the door is opened, the signal member falls from the support member due to gravity for viewing by the owner at a distant location.

U.S. Pat. No. 4,925,090 issued to Barrett on May 15, 1990 discloses a newspaper delivery signal comprising a plate pivotally connected to the bottom wall of a newspaper box having an open front. In the "set" position prior to deposit of a newspaper in the box, the plate is positioned in a vertical position relative to the box immediately in front of and partly covering the open front thereof. The bottom end of the plate is curved to receive a tethered cylindrical signal member thereon. In order for a delivery person to deposit a newspaper in the box, the plate must be pushed inwardly at the opening thereby pivoting the plate to a near horizontal position which releases the signal member for viewing by the owner from a distant location.

U.S. Pat. No. 2,815,167 issued to Bailes et al on Dec. 3, 1957 discloses a tethered ball signal device where the free end of the tether includes a removable hook. Prior to attaching the hook to the tether, the free end thereof is passed upwardly through a hole in the bottom wall of the mailbox housing. With the hook attached to the tether, the hook is engaged between the top front edge of the housing and the door with the door placed in the closed position. Upon opening the door, the hook releases causing the tether to freely pass through the hole in the box in the opposite direction with the ball hanging from the opposite end thereof for viewing by an owner at a distant location.

It may thus be realized that there exists a variety of mailbox signaling devices which automatically move the device to a signaling position upon opening of the mailbox door, presumably by a mail carrier placing mail in the box. There remains, however, potential problems associated with the prior art signaling devices. For example, the support arm of the '953 device could cause injury due to the blunt, free end thereof which protrudes from the mailbox door. Furthermore, the post supporting the mailbox could obstruct the view of the fallen signal members of the '953, '966, '090, and '167 devices.

SUMMARY OF THE INVENTION

It is therefore a principle object of the present invention to provide a mailbox signal device which does not include any portions thereof which could injure a person through inadvertent contact therewith.

It is a further object of the present invention to provide a mailbox signal device which includes an aerodynamically configured signal member which is easily brought into motion by wind currents when in the signaling position, and which is thereby more visually noticeable to a person located a significant distance therefrom.

It is another object of the present invention to provide a mailbox signal device of the above type which is made of few parts and which may be easily and quickly mounted to a mailbox.

Other objects will in part be obvious and in part appear hereinafter.

In accordance with the foregoing objects, the invention comprises a mail delivery signaling device which is permanently mounted to a conventional rural mailbox having a mailbox door which is hinged to the front bottom edge of the mailbox housing and opens and closes in downward and upward directions, respectively. The signaling device includes an aerodynamically configured signal ball which is tethered to a signal ball support bracket which itself is permanently attached to the outer surface of the mailbox door. The signal ball is symmetrically formed from three circular, planar discs of equal diameters which integrally intersect with each other about a common center and along mutually perpendicular planes to form eight sectored quadrants. This configuration catches even the slightest air currents to bring the signal ball into swinging motion from its tethered attachment when in the signaling position.

A signal ball support bracket is directly mounted to the outer surface of the mailbox door and includes portions thereof adapted to removably engage and support the signal ball which "sets" the device prior to the delivery of mail within the box. The support bracket includes a backing plate which is mounted in contacting engagement with the mailbox door. A support member integrally extends perpendicularly therefrom such that it lies substantially horizontal when the mailbox door is in the closed position. The support includes a circular aperture having a diameter less than the diameter of the signal ball such that the signal ball may be removably seated upon the support member in the aperture. Upon opening of the door in the downward direction, the signal ball falls freely from the support member and hangs by its tether until repositioned upon the support member.

DETAILED DESCRIPTION

Figure 1:
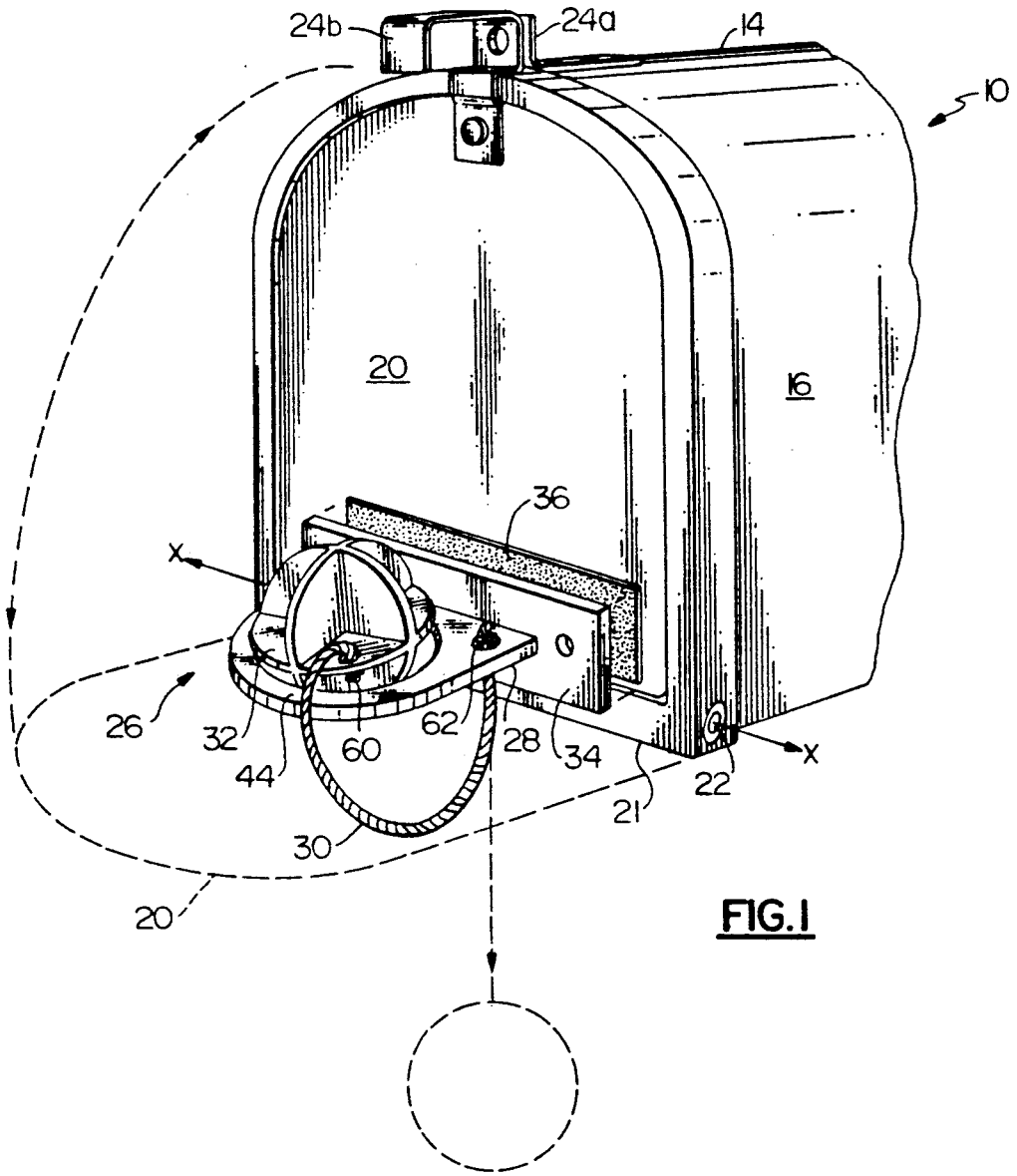
FIG. 1 is a fragmentary perspective view of the front of a mailbox including the mailbox door with the mail delivery signal device being shown in spaced relation thereto with the signal ball in the set position (solid lines) and in the signaling position (dashed lines)
Figure 5:
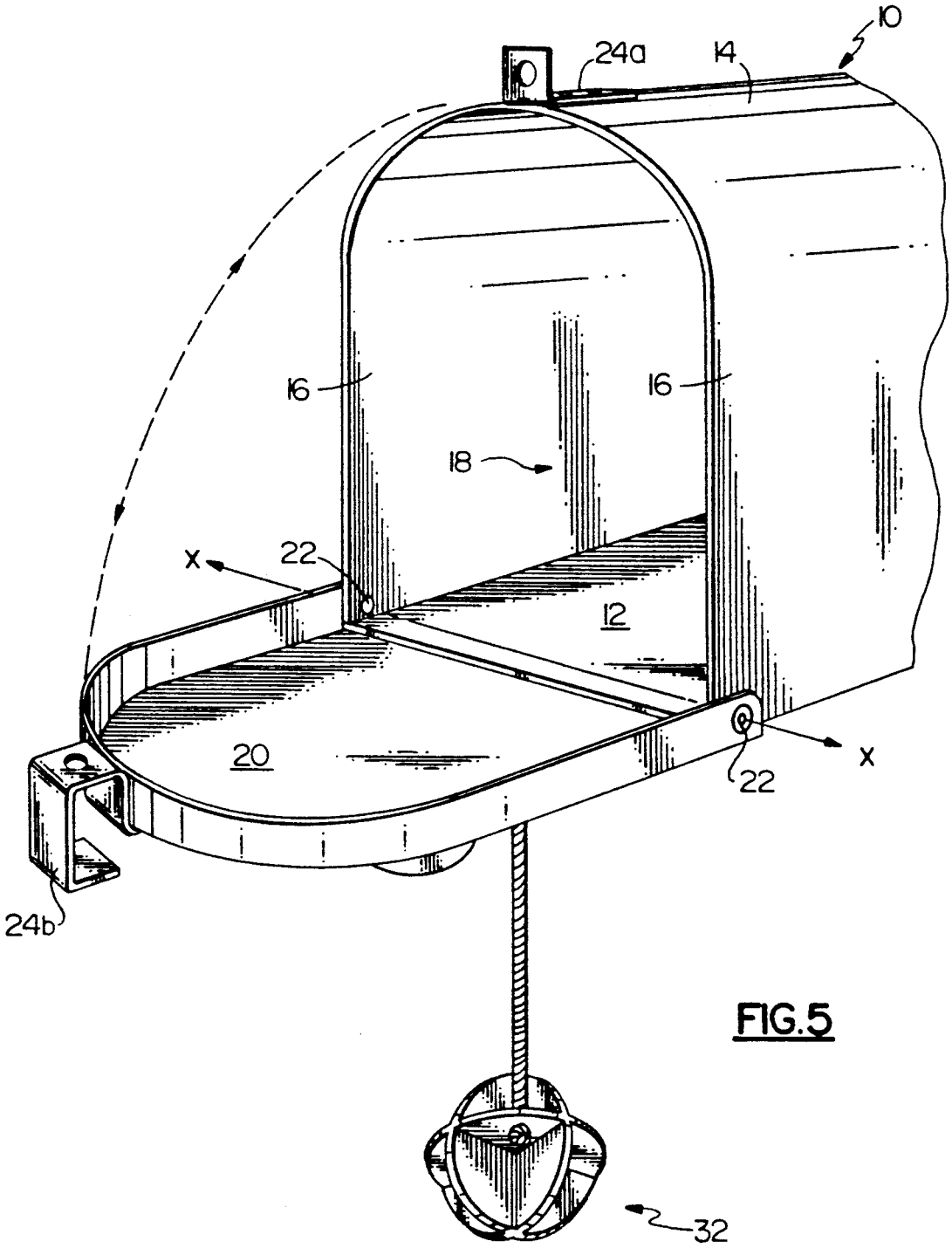
FIG. 5 is a fragmentary perspective view showing the mailbox door open and the signal ball in the signaling position.

Referring now to the drawings, there is seen in FIGS. 1 and 5 the fragmented front portion of a conventional rural mailbox 10 having a housing formed by a bottom wall 12 and top and side walls 14 and 16, respectively, defining an open front 18. A door 20 is pivotally connected about an axis x—x to opposite side walls 16 adjacent bottom wall 12 and open front 18 by rivets 22. Door 20 may thus be moved about axis x—x between the closed and open positions seen in FIGS. 1 and 5, respectively, with a conventional friction latch **24*a* and 24*b* releasably securing door 20 to housing top wall 14** when moved to the closed position.

Figure 2:
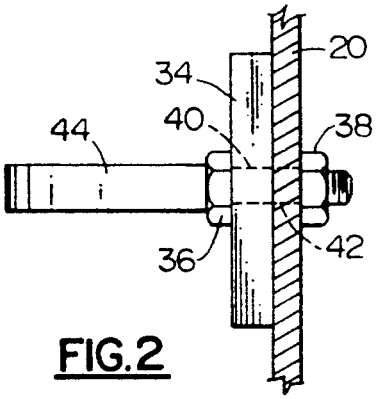
FIG. 2 is a fragmentary, side elevational view, partly in section, of the support bracket shown mounted to the mailbox door with a bolt and nut assembly.
Figure 4:
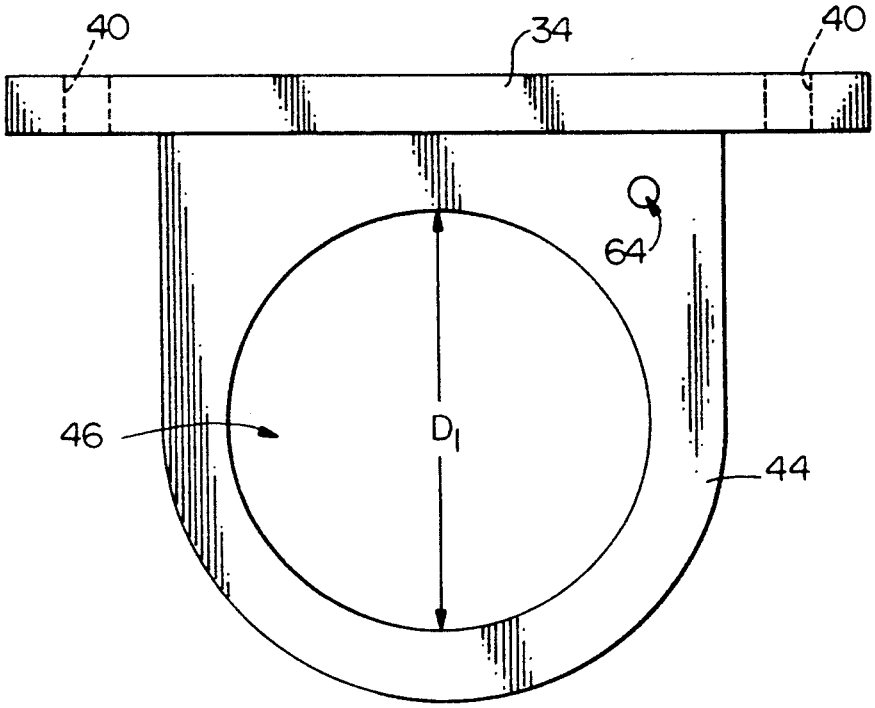
FIG. 4 is a top plan view of the support bracket seen in FIGS. 1 and 2.

The mailbox signal device is generally indicated by reference numeral 26 and is seen in FIG. 1 to comprise three basic components, namely, a support bracket 28, tether 30 and signal ball 32. As seen best in FIGS. 1, 2 and 4, support bracket 28 includes a rectangular backing plate 34 which is secured to the outwardly facing surface of mailbox door 20, preferably adjacent the bottom edge 21 thereof with the longest edges of backing plate 34 extending parallel to the bottom edge 21 of door 20. Securing means are provided in FIG. 1 in the form of a pressure-sensitive adhesive 36 which is applied between backing plate 34 and door 20. Alternatively, securing means are provided in the form of a bolt and nut assembly 36 and 38 (FIG. 2) which is passed through aligned apertures 40 and 42 formed adjacent both ends of backing plate 34 and in door 20, respectively.

Support bracket 28 further includes a signal ball support member 44 integrally attached to backing plate 34 and extending perpendicularly therefrom. Signal ball support member 44 is of planar, semi-circle configuration including a central, circular hole 46 having a diameter $D_1$ wherein signal ball 32 is seated when in the "set" position as will be described more fully hereinafter.

Figure 3:
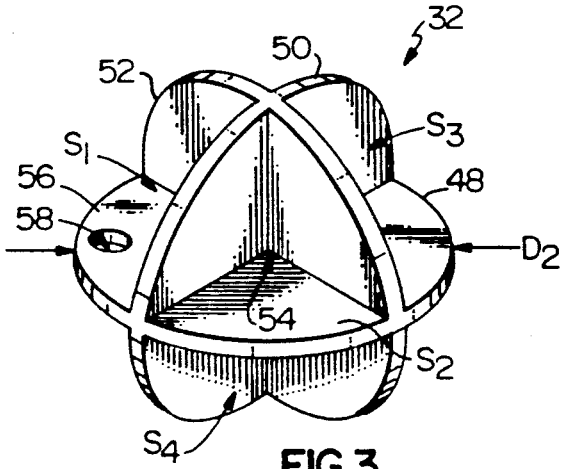
FIG. 3 is a perspective view of the signal ball seen in FIG. 1.

Reference is now made to signal ball 32 and FIG. 3 where signal ball 32 is seen to be aerodynamically configured for purposes explained below. Specifically, signal ball 32 is symmetrically formed by three integral, intersecting, circular discs 48, 50 and 52 which are all of equal diameter $D_2$ and have a common center at 54 such that the perimeters of each disc 48, 50 and 52 are contiguous with each other. Discs 48, 50 and 52 lie along mutually perpendicular planes with signal ball 32 thus being divided into a total of eight equal sectored quadrants $S_1$–$S_8$ with four of the quadrants $S_1$–$S_4$ seen in FIG. 3. One sector 56 of one of the discs 48 is seen to include a through hole 58 for tethering signal ball 32 to support bracket 28 as seen in FIG. 1. Specifically, a first end 60 of tether 30 is passed through hole 58 and knotted with the second end 62 thereof being passed through a through hole 64 (FIG. 4) formed in signal ball support member 44 and knotted. As such, signal ball 32 is securely tethered to support bracket 28.

To operate the device, the mailbox owner who wishes the device to signal the presence of mail in the box "sets" the device by closing door 20 and placing signal ball 32 on the upwardly facing surface of signal ball support member 44 in hole 46. The diameter $D_1$ of hole 46 is slightly less than the diameter $D_2$ of signal ball 32 such that ball 32 will not fall entirely through hole 46 and is securely yet removably seated within hole 46 as seen in FIG. 1. Upon opening of door 20, as would occur when a mail delivery person wishes to deposit mail in box 10, signal ball 32 falls freely from its seated position on support member 44 and becomes suspended by tether 30 as seen in FIG. 5 and in dashed lines in FIG. 1. Following deposit of mail within the box, the mail person closes door 20 without re-setting signal ball 32 within hole 46 which leaves ball 32 suspended below box 10 by tether 30 for the clear viewing by the owner from a remote location (from a window in the house, for example). The aerodynamic configuration of ball 32 brings ball 32 into swinging motion by even the slightest air currents, for example by the air currents caused by a passing car. As such, the signal ball 32 is much easier to see as a moving signal and will not be obstructed by the post supporting the mailbox above the ground.

What is claimed is:

1. A mail delivery signal device for a mailbox having a door which pivotally connects to the mailbox housing and may be moved between open and closed positions in downward and upward directions, respectively, about a horizontal pivot axis, said device comprising:

a) a signal ball having a first maximum diameter;

b) a signal ball support bracket including a planar signal ball support member having a circular hole formed therethrough, said circular hole having a second diameter smaller than said first diameter;

c) means attaching said signal support bracket to said mailbox door with said signal ball support member extending perpendicularly from said door and lying in a horizontal plane when said door is in said closed position; and d) a tether of predetermined length attaching said signal ball to said signal ball support bracket, said signal ball being removably positionable in said circular hole in said signal ball support member when said door is in said closed position, said opening of said door causing said signal ball to fall from said signal ball support member and become suspended by said tether at a point below said mailbox housing.

2. The invention according to claim 1 wherein said signal ball is symmetrical and comprises three circular, planar discs of equal diameters integrally intersecting with each other about a common center and about mutually perpendicular planes forming eight equal, sectored quadrants.

3. The invention according to claim 2 wherein said signal ball support bracket includes a planar backing plate perpendicularly attached to said signal ball support member, said backing plate attached in contacting, covering relation to said mailbox door with said signal ball support member extending perpendicularly therefrom.

4. The invention according to claim 3 wherein said means attaching said signal ball support bracket to said mailbox door comprises a pressure-sensitive adhesive applied between said backing plate and said door.

5. The invention according to claim 3 wherein said means attaching said signal ball support bracket to said mailbox door comprises aligned apertures formed in said backing plate and said door and a bolt and nut assembly passed through and secured about said aligned apertures.

* * * * *